US006830202B2

(12) United States Patent
Coldren

(10) Patent No.: US 6,830,202 B2
(45) Date of Patent: Dec. 14, 2004

(54) TWO STAGE INTENSIFIER

(75) Inventor: Dana R. Coldren, Fairbury, IL (US)

(73) Assignee: Caterpillar Inc, Peoria, IL (US)

( * ) Notice: Subject to any disclaimer, the term of this patent is extended or adjusted under 35 U.S.C. 154(b) by 279 days.

(21) Appl. No.: 10/104,775

(22) Filed: Mar. 22, 2002

(65) Prior Publication Data

US 2003/0178508 A1 Sep. 25, 2003

(51) Int. Cl.[7] ..... F02M 59/00; F02M 61/00; B05B 1/30

(52) U.S. Cl. ..... 239/533.2; 239/533.3; 239/585.1; 239/585.3; 239/585.5; 239/88

(58) Field of Search ..... 239/533.2, 533.3, 239/533.8, 533.9, 585.1–585.5, 88–93, 900; 251/129.15, 129.21

(56) References Cited

U.S. PATENT DOCUMENTS 5,826,562 A 10/1998 Chen et al.
6,047,899 A * 4/2000 Graves ..... 239/90
6,053,421 A * 4/2000 Chockley ..... 239/5
6,113,000 A * 9/2000 Tian ..... 239/88

FOREIGN PATENT DOCUMENTS

WO WO 00/70216 11/2000

* cited by examiner

*Primary Examiner*—Davis Hwu
(74) *Attorney, Agent, or Firm*—Mike Huber; Steve Noe

(57) ABSTRACT

A two stage intensifier capable of multiple intensification rates comprises a stepped top portion and a shoulder portion, each being actuated by separate fluid passages. A stepped top portion is received into an upper bore of a piston bore and a shoulder is received into a lower bore. The stepped top forms a seal with the upper bore to prevent direct fluid communication between a first actuation cavity above the stepped top and a second actuation cavity above the shoulder.

24 Claims, 2 Drawing Sheets

TWO STAGE INTENSIFIER

TECHNICAL FIELD

The present invention relates generally to an intensifier piston capable of multiple intensification rates.

BACKGROUND

Intensifier pistons can be used in a variety of applications in which it is necessary to intensify the pressure of a fluid from a first pressure to a second pressure. For example, intensifier pistons are very common in valve actuators and fuel injectors. Specifically, in a fuel injector, the intensifier is used to increase the fuel pressure from low or medium pressure to high pressure for fuel injection.

Intensifier pistons in a fuel injector can be cam operated or hydraulically operated. With a hydraulically operated intensifier, the top of the intensifier piston is exposed to a pressurized fluid causing the piston to move downward, thereby moving a plunger and pressurizing low pressure fuel in a pressurization chamber. The rate of intensification depends upon the pressure of the actuation fluid on top of the intensifier piston as well as the area of the intensifier piston exposed to the actuation fluid.

When intensifiers were first used in fuel injection systems, they were only able to provide one rate of intensification per injection event. This initial problem was solved with a development of a stepped top piston as illustrated in U.S. Pat. No. 5,826,562 issued Chen et al. The stepped top piston allows two different intensification rates during a single injection event. Actuation fluid is exposed to a first area, on the stepped top, causing a first intensification rate. As the piston moves downward, the stepped top comes out of its bore exposing a second actuation area, the shoulder of the intensifier, to actuation fluid and increasing the intensification ratio. Although this is a beneficial design, improvements can be made. First, there is no ability to choose intensification rates; every injection event gets both intensification profiles. Second, the design is inefficient with its actuation fluid usage because the second area must be filled with fluid as the piston moves down before the second area becomes effective. This results in the need for extra actuation fluid in the cavity, a slight delay in increased pressurization and difficulty in fully returning the plunger between injections, especially in cold conditions.

The present invention is designed at overcoming one or more of the above problems.

SUMMARY OF THE INVENTION

In the first embodiment of the present invention, a fuel injector comprises a barrel defining a first fluid passage, a second fluid passage, and a piston bore with an upper bore and a lower bore. An intensifier piston includes a shoulder and a stepped top. A first actuation cavity is defined by the upper bore, the stepped top and the first fluid passage and a second actuation cavity is defined by the lower bore, the shoulder and the second fluid passage. The piston is slidably received in the piston bore, wherein the shoulder is received in the lower bore and the stepped top is received in the upper bore. The stepped top has a first surface open to fluid pressure in the first actuation cavity and the shoulder has a second surface open to the fluid pressure in the second actuation cavity. The piston is movable between the first position and the second piston and the stepped top is sealable with the upper bore when the piston moves between the first position and the second position. Additionally, the fuel injector comprises a source of actuation fluid, a drain passage, and a control valve to open and close fluid communication between the first and second fluid passages and the source of actuation fluid and the drain.

In a second embodiment of the present invention, a method for operating an intensifier piston, having a first effective area and a second effective area, comprises delivering a first fluid flow from a common fluid source to the first area, moving the intensifier piston a first pre-selected distance, delivering a second fluid flow from the common fluid source to the second area, moving the intensifier piston a second pre-selected distance, and maintaining the first area in direct fluid isolation from the second area.

In the third embodiment of the present invention, a method for operating an intensifier piston system includes delivering a first signal, moving a valve to a first position response to the first signal, allowing fluid flow to a first effective area of an intensifier piston, delivering a second signal, moving the valve to a second position response to the second signal and allowing the fluid flow to a second effective area of the intensifier piston.

In a fourth embodiment of the present invention, an intensifier assembly comprises a barrel defining a first fluid passage, a second fluid passage and a piston bore having an upper bore and a lower bore. An intensifier piston includes a shoulder and a stepped top. A first actuation cavity is defined by the upper bore, the stepped top and the first fluid passage. A second actuation cavity is defined by the lower bore, shoulder and the second fluid passage. The piston is slidably received in the piston bore, wherein the shoulder is received in the lower bore and the stepped top is received in the upper bore. The stepped top has a first surface open to fluid pressure in the first actuation cavity and a shoulder has a second surface open to fluid pressure in the second actuation cavity. Finally, the piston is movably between a first position and a second position wherein the stepped top is sealable with the upper bore when the piston moves between the first position and the second position.

DETAILED DESCRIPTION

Figure 1:
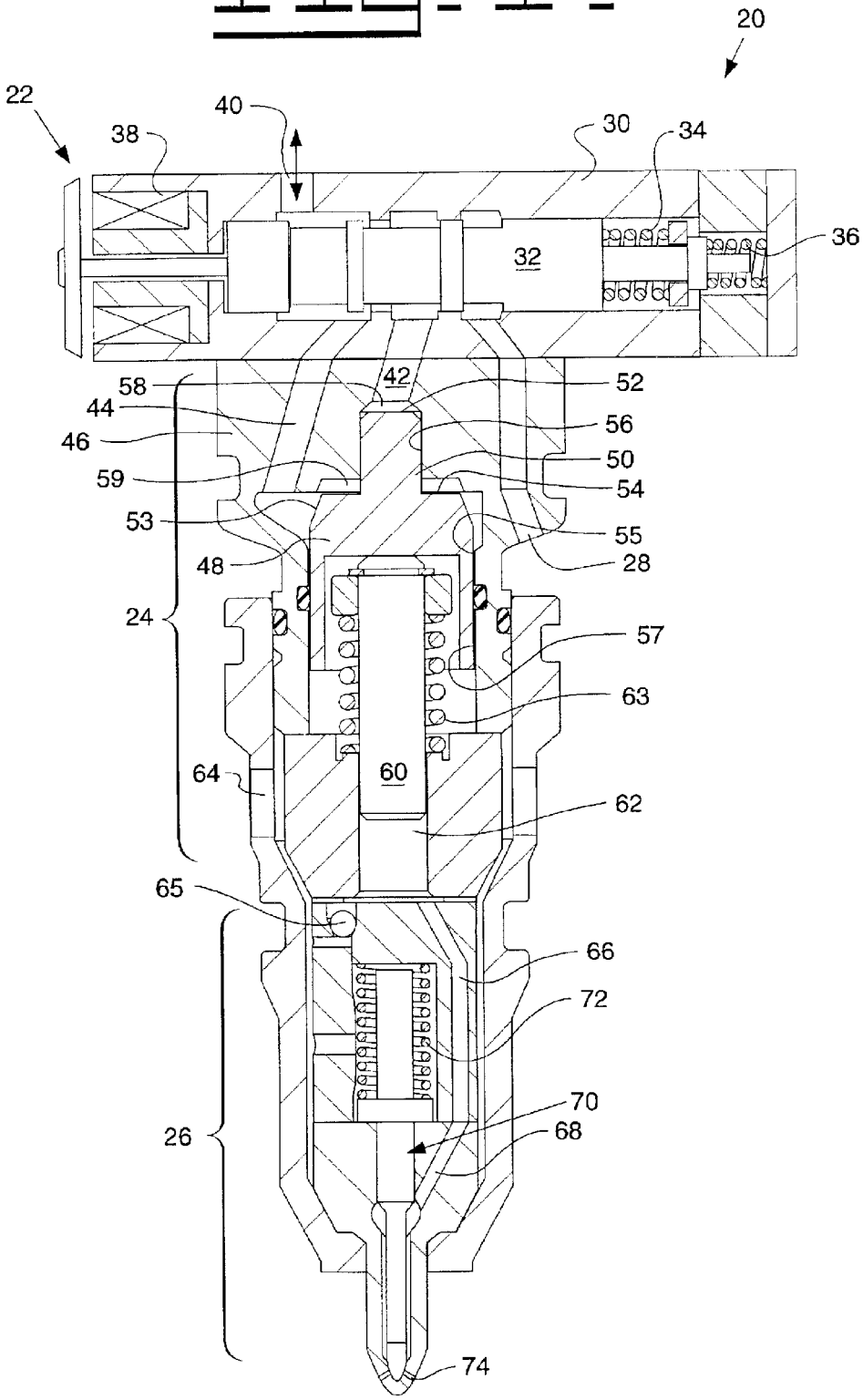
FIG. 1 is a diagrammatic cross-section of a fuel injector according to the present invention.

FIG. 1 is a diagrammatic cross-section of a fuel injector 20 according to the present invention. Fuel injector 20 includes a control valve 22 an upper body 24 and a nozzle assembly 26. Supply line 28 provides actuation fluid through upper body 24 to control valve 22.

Control valve 22 includes a valve body 30, a three position spool 32 and first valve spring 34 and second valve spring 36. Spool 32 is actuated by solenoid 38 against the biasing force of first and second valve springs 34 and 36. Spool valve 32 controls fluid communication of actuation fluid between supply line 28 or drain 40 and first pressure passage 42 and second pressure passage 44.

First pressure passage 42 and second pressure passage 44 carry actuation fluid from control valve 22 through barrel 46, in the upper body 24, to piston 48. Piston 48 is the intensifier piston which intensifies fuel within injector 20. Piston 48 includes a stepped top 50, with a first actuation area 52, and a shoulder 53, with a second actuation area 54. Piston 48 is slidably received within piston bore 55, which has an upper bore 56 and a lower bore 57. The stepped top 50 is received in upper bore 56 and shoulder 53 is received in lower bore 57. A first actuation cavity 58 is formed by stepped top 50, upper bore 56, and first pressure passage 42. A second actuation cavity 59 is formed by shoulder 53, lower bore 56 and second pressure passage 44. Finally, stepped top 50 forms a seal with upper bore 56 to prevent direct fluid communication between first actuation cavity 58 and second actuation cavity 59.

When first or second actuation areas are exposed to actuation fluid from first or second pressure passages 42 and 44, piston 48 is moved downward, actuating plunger 60. When actuated, plunger 60 pressurizes fuel in pressurization chamber 62. Piston 48 is generally biased in its upward position by piston return spring 63 and piston return spring 63 returns piston 48 to it upward position when first and second pressure passages 42 and 44 are vented to drain 40.

Fuel for injection enters the injector through fuel fill line 64 and passes through ball check 65 into pressurization chamber 62. Pressurized fuel from pressurization chamber 62 moves through fuel passage 66 and into fuel chamber 68. Check valve 70, biased in the close position by check spring 72, controls fluid communication of fuel between fuel chamber 68 and orifice 74. Check valve 70 is moved into the open position when fuel in fuel chamber 68 exceeds the spring force of check spring 72; called the valve opening pressure (VOP). When check valve 70 is open, fuel injection into the combusting chamber (not shown) can occur. When pressurization stops and the fuel pressure in chamber 68 decreases, check valve 70 is closed by check spring 72 and injection is stopped.

Industrial Applicability

Intensifier piston 48 provides great flexibility during injection events by allowing for a first pressurization rate, a second pressurization rate or multiple pressurization rates during a single injection event. Different pressurization rates are achieved by controlling how much area of piston 48 is exposed to pressurized fluid. Control valve 22 plays an important role in controlling the flow of actuation fluid between the stepped top 50 and the shoulder 53. As illustrated in FIG. 1, a single solenoid and a three position spool 32 are is used to control first pressure passage 42 and second pressure passage 44; however, alternative control valve embodiments could be used. For example, a multiple control valve scheme could be used in which two solenoids are used to control two, two position spool or poppet valves.

In order to achieve only a first pressurization rate during a single injection event, high pressure actuation fluid is supplied through supply line 28 to control valve 22. It should be noted that the high pressure actuation fluid is preferably lubrication oil but other fluids, such as diesel fuel or another engine fluid, could be used as well. In between injection events, spool 32 is at rest in its first position in which supply line 28 is blocked and both first pressure passage 42 and second pressure passage 44 are open to drain 40. In order to begin injection at the first pressurization rate, solenoid 38 is energized at a first current level causing spool 32 to move to a second position in which first pressure passage 42 is open to actuation fluid within supply line 28 and second pressure passage 44 is still blocked from supply line 28 and open to drain 40. In this configuration, actuation fluid travels through first pressure passage 42 into first actuation cavity 58 where it can act upon the first area 52 of stepped top 50. This causes piston 48, and therefore plunger 60, to move downwards, against the force of piston return spring 63, and pressurize fuel located in pressurization chamber 62. The pressurized fuel travels through fuel passage 66 into fuel chamber 68. The pressurized fuel then acts upon check valve 70, and pushes check valve 70 up against the force of check spring 72. When the check 70 moves upward, orifice 74 is open allowing fluid communication between fuel chamber 68 and the combustion chamber (not shown). When it is desirable to stop injection, solenoid 38 is de-energized, moving spool 32 back to its first position in which supply line 28 is blocked and both first pressure passage and second pressure passage first pressure passage 42 and second pressure passage 44 are open to drain 40. When first pressure passage 42 is open to drain, the first actuation fluid cavity 58 is also open to drain and the force of piston return spring 63 pushes piston back to its original or upward position. Additionally, the fuel pressure in fuel chamber 68 is decreased and check spring 72 forces check valve 70 down, closing orifice 74.

In order to maintain only the first pressurization rate through the injection event, the stepped top 50 must remain within upper bore 56 for the entire duration of the injection event. If stepped top 50 were to leave upper bore 56, actuation fluid from first actuation cavity 58 would be in direct communication with second actuation cavity 59, allowing actuation fluid to act upon second area 54 of shoulder 53. This would expose a larger area of piston 48 to actuation fluid and cause piston 48 to increase its pressurization rate. Additionally, it is important that stepped top 50 form an adequate seal with upper bore 56 to prevent direct fluid communication between first actuation cavity 58 and second actuation cavity 59 even when stepped top 50 is in upper bore 56.

In order to obtain only a second pressurization rate during a single injection event, solenoid 38 is energized only with a second current level causing spool 32 to move from its first position, in which both first pressure passage 42 and second pressure passage 44 are open to drain and supply line 28 is blocked, to a third position in which drain 40 is blocked and both first pressure passage 42 and second pressure passage 44 are open to actuation fluid in supply line 28. In this configuration, actuation fluid travels through both first pressure passage 42 and second pressure passage 44, exposing first actuation cavity 58 and second actuation cavity 59 to actuation fluid. Therefore, first area 52 of stepped top 50 and second area 54 of shoulder 53 are exposed to high pressure fluid within first actuation cavity 58 and second actuation cavity 59. This causes piston 48, and subsequently plunger 60, to move downward, against the force of piston return spring 63 at a second pressurization rate. This pressurization rate is greater than the first pressurization rate because a greater area of piston 48 is exposed to high pressure actuation fluid. Injection of the fuel and the termination of the injection event are similar to that described above.

Multiple pressurization rates can also be achieved during a single injection event. Initially, when solenoid 38 is not energized, spool 32 is in its first position in which actuation fluid from supply line 28 is blocked in both first pressure passage 42 and second pressure passage 44 are open to drain 40. Solenoid 38 is then energized to a first current level causing spool 32 to move to a second position in which first pressure passage 42 is open to actuation fluid in supply line 28 and second pressure passage 44 is still blocked from supply line 28 and open to drain 40. As described above, this creates a first pressurization rate for the fuel within the pressurization chamber 62. As the injection event progresses, solenoid 38 can be energized to a second current level causing spool 32 to move from its second position to its third position in which both first pressure passage 42 and second pressure passage 44 are open to actuation fluid in supply line 28 and drain 40 is blocked. This increases the area of piston 48 that is exposed to actuation fluid causing piston 48 to move downward at a greater rate and increase its pressurization rate of the fuel within pressurization chamber 62. Injection is stopped when solenoid 38 is de-energized, causing spool 32 to move from its third position back to its first position in which supply line 28 is blocked and both first pressure passage 42 and second pressure passage 44 are opened to drain 40. By venting first actuation cavity 58 and second actuation cavity 59, allowing piston return spring 63 moves piston 48 back to its original upward position.

Figure 2A:
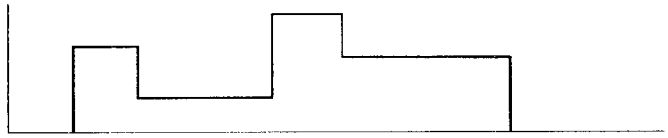
FIG. 2 is a diagrammatic illustration of a rate shape according to one embodiment of the present invention.
Figure 2B:
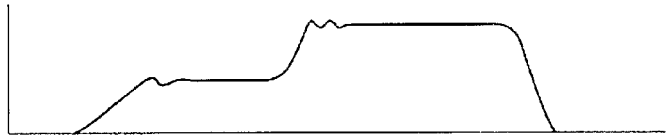
Figure 2C:
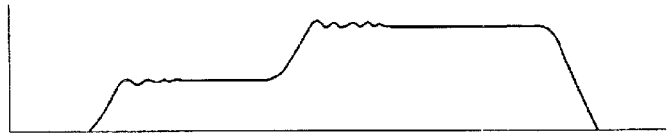
Figure 3A:
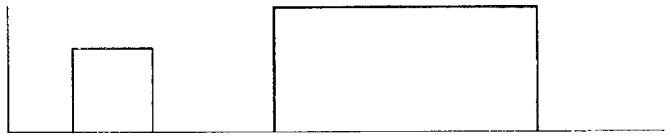
FIG. 3 is a diagrammatic illustration of a rate shape according to one embodiment of the present invention.
Figure 3B:
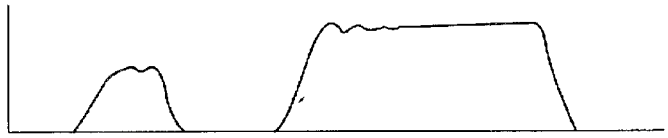
Figure 3C:
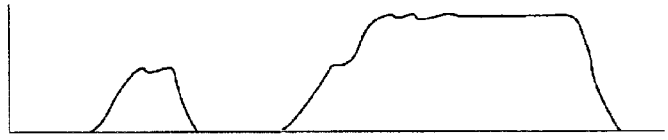
Figure 4A:
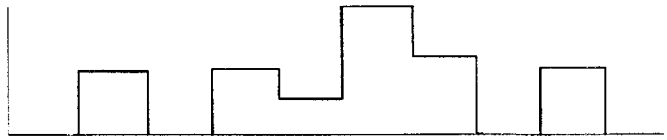
FIG. 4 is a diagrammatic illustration of a rate shape according to one embodiment of the present invention.
Figure 4B:
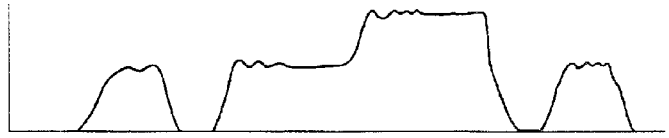
Figure 4C:
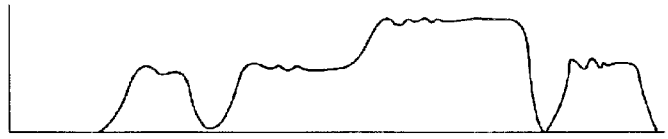

Multiple pressurization rates during a single injection event gives the injector flexibility in the injection rate shape. FIGS. 2–4 illustrate different possible rate shapes. In FIGS. 2–4, (*a*) is the current level to the solenoid 28, (*b*) is the spool 32 motion (spool position) and (*c*) is the injection rate. In all cases the variables are plotted on the vertical axis against time on the horizontal axis. FIG. 2 illustrates a boot injection. FIG. 3 illustrates a pilot and a square and FIG. 4 illustrates a pilot, boot and a post. It should be noted that FIGS. 2–4 illustrate current levels for a spool valve that has initial pull current levels and then a decreased holding level. For example, in FIG. 2*a* a first current level is applied to move spool 32 from its first position to its second position. The current level is then reduced to a holding current which increases efficiency but still holds spool 32 in the second position. A third current level is then applied to move spool 32 from the second position to the third position. Again, after moving the spool, the current level is reduced to a fourth current level to hold the spool in the third position. Finally, current is stopped to move the spool 32 back to the first position. As stated previously, the exact workings of the valve are not critical to the piston's 48 operation. In the previous descriptions, differentiating between pulling and holding currents was ignored to simplify the description but these current levels as illustrated in FIGS. 2–4 could be used to control spool 32 and ultimately piston 48.

By having two separate areas of piston 48 exposed to actuation fluid through separate means, first actuation cavity 58 and second actuation cavity 59, plunger 60 return is improved. In previous designs all the actuation fluid acting on the piston needed to be pushed out of the main fluid passage (on top of the stepped piston) or through a rate shaping orifice, which restricted flow to and from the shoulder of the piston. With the present design, both stepped top 50 and shoulder 53 are associated with actuation cavities 58 and 59 that have full sized fluid passages in communication with drain 40. This allows piston return spring 63 to quickly and smoothly return piston 48 to its original, upward position because the actuation cavities 58 and 59 vent quickly. This in turn, helps the injector during cold starts by insuring piston 48 is quickly returned even though the actuation fluid may be more viscous than normal.

The present description has illustrated a conventional check valve nozzle that opens or closes depending upon when fuel pressure is greater than the valve opening pressure (the force of the check spring 72). However, the present invention could be used with a direct operated check nozzle as well. A direct operated check would open or close independently when fuel is pressurized. Typically a direct operated check would have its own control valve associated with it, allowing independent pressurization and injection signals to be delivered to the injector.

The present invention has also been illustrated as a way to obtain multiple pressurization rates within a hydraulically actuated electronically controlled fuel injector; however, the present intensifier configuration can be used anywhere multiple pressurization rates are necessary including intensified common rail systems and general hydraulic valve actuators. For example, this intensifier design could be implemented in an actuation valve in which different opening positions are achieved based upon pressurization of an actuation fluid.

It should be understood that the above description be intended for illustrative purposes only and is not intended to limit the scope of the present invention in anyway. Thus, those skilled in the art will appreciate that other aspects, objects and advantages of the invention can be obtained from a study of the drawings, the disclosure and the claims.

What is claimed is:

1. A fuel injector comprising:

a barrel defining a first fluid passage, a second fluid passage and a piston bore including an upper bore and a lower bore;

an intensifier piston including a shoulder and a stepped top;

a first actuation cavity defined by said upper bore, said stepped top and said first fluid passage;

a second actuation cavity defined by said lower bore, said shoulder and said second fluid passage;

said piston being slidably received in said piston bore wherein said shoulder is received in said lower bore and said stepped top is received in said upper bore;

said stepped top having a first surface open to fluid pressure in said first actuation cavity and said shoulder having a second surface open to fluid pressure in said second actuation cavity;

said piston being moveable between a first position and a second position; said stepped top being sealable with said upper bore when said piston moves between said first position and said second position;

a source of actuation fluid;

a drain passage;

a control valve to open and close fluid communication between said first and second fluid passages and said source of actuation fluid and said drain passage.

2. The fuel injector of claim 1 wherein said first surface defines a first area open to fluid pressure in said first actuation cavity; and said second surface defines a second area open to fluid pressure in said second actuation cavity.

3. The fuel injector of claim 2 wherein said first area is smaller than said second area.

4. The fuel injector of claim 2 wherein said first surface and said second surface are axially aligned.

5. The fuel injector of claim 1 wherein said second surface is annular in shape.

6. The fuel injector of claim 1 wherein said piston isolates said upper bore from fluid communication from said lower bore.

7. The fuel injector of claim 1 further including a piston return spring.

8. The fuel injector of claim 1 further including a plunger actuated by said piston.

9. The fuel injector of claim 1 wherein said control valve includes a three position spool.

10. The fuel injector of claim 9 wherein said control valve opens said first and second fluid passages to said drain when said control valve is in a first position.

11. The fuel injector of claim 9 wherein said control valve isolates said first fluid passage from said drain and opens fluid communication between said first fluid passage and said source of actuation fluid when said control valve is in a second position.

12. The fuel injector of claim 9 said control valve isolates said first and said second fluid passages from said drain and opens fluid communication between said first and second fluid passages and said source of actuation fluid when said control valve is where in a third position.

13. The fuel injector of claim 1 wherein said control valve includes a solenoid.

14. A method of operating an intensifier piston arrangement, an intensifier piston having a first effective area partially defining a first actuation cavity and a second effective area partially defining a second actuation cavity, the method comprising:

delivering a first fluid flow from a common fluid source to said first actuation cavity;

moving said intensifier piston a first preselected distance;

delivering a second fluid flow from said common fluid source to said second actuation cavity;

moving said intensifier piston a second preselected distance;

maintaining said first area in direct fluid isolation from said second actuation cavity.

15. The method of claim 14 further including sending a first signal and moving a valve from a first position to a second position.

16. The method of claim 15 further including sending a second signal and moving said valve to a third position.

17. The method of claim 16 further including sending a third signal and moving said valve to a first position and draining said fluid flow from said first and second actuation cavities.

18. The method of claim 15 further including sending a second signal and moving a second valve from a first position to a second position.

19. A method of operating a intensifier piston system comprising:

delivering a first signal;

moving a valve to a first position in response to said first signal;

allowing fluid flow to a first effective area of an intensifier piston, said first area partially defining a first actuation cavity;

delivering a second signal;

moving said valve to a second position in response to said second signal;

allowing a fluid flow to a second effective area of said intensifier piston, said second area partially defining a second actuation cavity.

20. The method of claim 19 wherein moving a valve to a first position includes moving a three position spool valve to said first position.

21. The method of claim 19 further including allowing said fluid flow to a stepped top of said intensifier piston.

22. The method of claim 19 further including allowing said fluid flow to a shoulder of said intensifier piston.

23. The method of claim 19 further including maintaining said first actuation cavity in direct fluid isolation from said second actuation cavity.

24. The method of claim 19 further including:

delivering a third signal;

moving said valve to a third position in response to said third signal; and draining said fluid flow from said first and second actuation cavities.

* * * * *

UNITED STATES PATENT AND TRADEMARK OFFICE

CERTIFICATE OF CORRECTION

PATENT NO. : 6,830,202 B2
DATED : December 14, 2004
INVENTOR(S) : Dana R. Coldren It is certified that error appears in the above-identified patent and that said Letters Patent is hereby corrected as shown below:

Column 8,
After line 37, add the following claim:

25. An intensifier assembly comprising:

a barrel defining a first fluid passage, a second fluid passage and a piston bore including an upper bore and a lower bore;

an intensifier piston including a shoulder and a stepped top;

a first actuation cavity defined by said upper bore, said stepped top and said first fluid passage;

a second actuation cavity defined by said lower bore, said shoulder and said second fluid passage;

said piston being slidably received in said piston bore wherein said shoulder is received in said lower bore and said stepped top is received in said upper bore;

said stepped top having a first surface open to fluid pressure in said first actuation cavity and said shoulder having a second surface open to fluid pressure in said second actuation cavity;

said piston being moveable between a first position and a second position; said stepped top being sealable with said upper bore when said piston moves between said first position and said second position.

Signed and Sealed this

Twenty-sixth Day of April, 2005

JON W. DUDAS
*Director of the United States Patent and Trademark Office*